US008992307B2

(12) United States Patent
Young

(10) Patent No.: US 8,992,307 B2
(45) Date of Patent: Mar. 31, 2015

(54) SECONDARY GAME INITIATED AFTER A LOSS

(75) Inventor: Kent Young, Reno, NV (US)

(73) Assignee: Deforest Fox, LLP, Reno, NV (US)

( * ) Notice: Subject to any disclaimer, the term of this patent is extended or adjusted under 35 U.S.C. 154(b) by 275 days.

(21) Appl. No.: 13/562,916

(22) Filed: Jul. 31, 2012

(65) Prior Publication Data

US 2013/0035153 A1 Feb. 7, 2013

Related U.S. Application Data

(60) Provisional application No. 61/515,903, filed on Aug. 6, 2011.

(51) Int. Cl.

| | |
|---|---|
| ***A63F 9/00*** | (2006.01) |
| ***G07F 17/32*** | (2006.01) |
| ***G07F 17/34*** | (2006.01) |

(52) U.S. Cl.

CPC ..... *G07F 17/3258* (2013.01); *G07F 17/3267* (2013.01); *G07F 17/34* (2013.01)

USPC ..... 463/25

(58) Field of Classification Search

None

See application file for complete search history.

(56) References Cited

U.S. PATENT DOCUMENTS

| | | | | |
|---|---|---|---|---|
| 8,616,959 | B2 * | 12/2013 | Iddings et al. | 463/25 |
| 2002/0163127 | A1 * | 11/2002 | Perrie et al. | 273/274 |
| 2003/0027619 | A1 * | 2/2003 | Nicastro, Sr. | 463/16 |
| 2004/0248651 | A1 * | 12/2004 | Gagner | 463/42 |
| 2005/0288088 | A1 * | 12/2005 | Englman et al. | 463/16 |
| 2006/0025201 | A1 * | 2/2006 | Van Asdale | 463/20 |
| 2006/0128461 | A1 * | 6/2006 | Okada | 463/25 |
| 2006/0246980 | A1 * | 11/2006 | Walker et al. | 463/13 |
| 2007/0060292 | A1 * | 3/2007 | Peterson | 463/20 |
| 2007/0105615 | A1 * | 5/2007 | Lind | 463/17 |
| 2009/0118001 | A1 * | 5/2009 | Kelly et al. | 463/29 |
| 2009/0118005 | A1 * | 5/2009 | Kelly et al. | 463/31 |
| 2009/0118006 | A1 * | 5/2009 | Kelly et al. | 463/31 |
| 2009/0124320 | A1 * | 5/2009 | DeWaal | 463/16 |
| 2009/0124390 | A1 * | 5/2009 | Seelig et al. | 463/42 |
| 2009/0176558 | A1 * | 7/2009 | Englman et al. | 463/25 |
| 2009/0275393 | A1 * | 11/2009 | Kisenwether et al. | 463/25 |
| 2010/0120514 | A1 * | 5/2010 | Caputo | 463/22 |
| 2011/0130198 | A1 * | 6/2011 | Van Linden | 463/27 |
| 2011/0319158 | A1 * | 12/2011 | Champagne et al. | 463/25 |
| 2014/0243075 | A1 * | 8/2014 | Kisenwether et al. | 463/25 |

* cited by examiner

*Primary Examiner* — Seng H Lim

(74) *Attorney, Agent, or Firm* — Marc D. Foodman; Watson Rounds

(57) ABSTRACT

A gaming system and method for use in one or more casino establishments for offering a secondary game initiated after a loss. The gaming machine and method are offered on electronic gaming machines such as slot machines and video poker machines, but may also be deployed in other forms such as on a general purpose computing device in stand-alone form or connected to a network such as the internet.

18 Claims, 8 Drawing Sheets

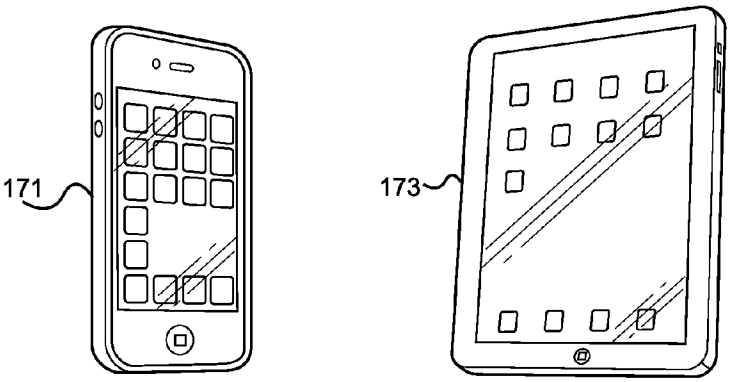
FIG. 1B
FIG. 1C
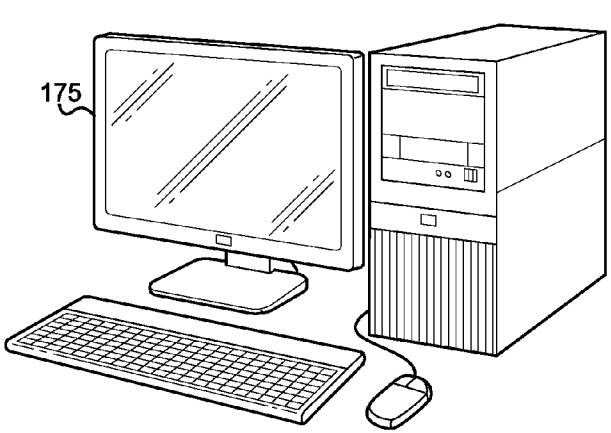
FIG. 1D
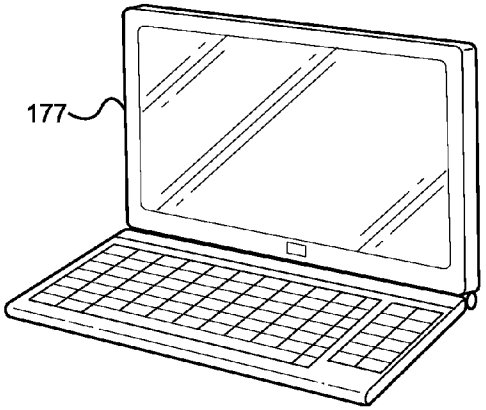
FIG. 1E
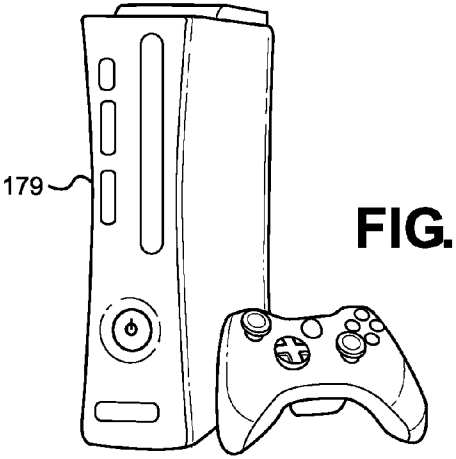
FIG. 1F

SECONDARY GAME INITIATED AFTER A LOSS

RELATED APPLICATION INFORMATION

This application claims priority benefit from U.S. Provisional Application No. 61/515,903, filed on Aug. 6, 2011.

COPYRIGHT NOTICE

Portions of this disclosure contain material in which copyright is claimed by the applicant. The applicant has no objection to the copying of this material in the course of making copies of the application file or any patents that may issue on the application, but all other rights whatsoever in the copyrighted material are reserved.

BACKGROUND

Electronic gaming machines ("EGMs") offer a variety of games such as slot games, video poker games, roulette games, keno games and other types of wagering games that are commonly deployed at a casino for use by players. Play on the EGMs typically requires the player to place a wager on the outcome of a primary game. On many such EGMs, secondary games or bonus rounds are also available after the player qualifies by attaining a certain winning combination or event on or related to the primary game. The player would then enter the secondary game or bonus round where they have an opportunity to win extra game credits, game tokens or other awards. The player automatically enters the secondary game or bonus round upon achieving a winning game outcome, or alternatively, when a bonus symbol appears in a predetermined position on the reels of a slot game (or the game display of another type of game) upon completion of the game. The player may be awarded credits for winning the base game and then additional credits for winning the secondary game.

Historically, the format of game play with winning combinations entitling the player to enter a secondary or bonus round have worked well for players and gaming establishments. They generate player excitement and maintain the interest of the player. However, for a player who hits a streak of losses, it may result in the player leaving the game, and possibly the gaming establishment without further play.

The present invention is a gaming system and method for offering a second chance to a player. Like other games played on an EGM, the player places an initial wager to play. A random number generator on the EGM generates an outcome and that outcome is displayed on the EGM display to the player. In the event the outcome is a winning combination, the player is awarded a prize in accordance with the EGM pay table. In the event that the outcome is a losing combination, the player is not awarded a prize. However, in accordance with the present invention, the game moves to a second chance where the player is provided additional play and the opportunity to win a prize despite losing on the base game. Eligibility for play of the second chance opportunity may be provided as a function of standard game play, or it may require an optional buy-in wager placed by the player. The optional buy-in may be presented at the beginning of the base game, or at the end of the base game, but before the second chance. It is also possible to offer the secondary game function either through the stand-alone EGM game program, or through a server networked to the EGM, such that multiple players' wagers are pooled together to provide available funding for prizes. A networked game provides greater flexibility in designing the game for payout volatility and prize size.

BRIEF DESCRIPTION OF THE DRAWINGS:

For a better understanding of the present invention, and to show more clearly how it functions, reference will now be made, by way of example, to the accompanying drawings. The drawings show embodiments of the present invention in which:

FIGS. 1B-1F show computing devices for playing a game;

Figure 1A:
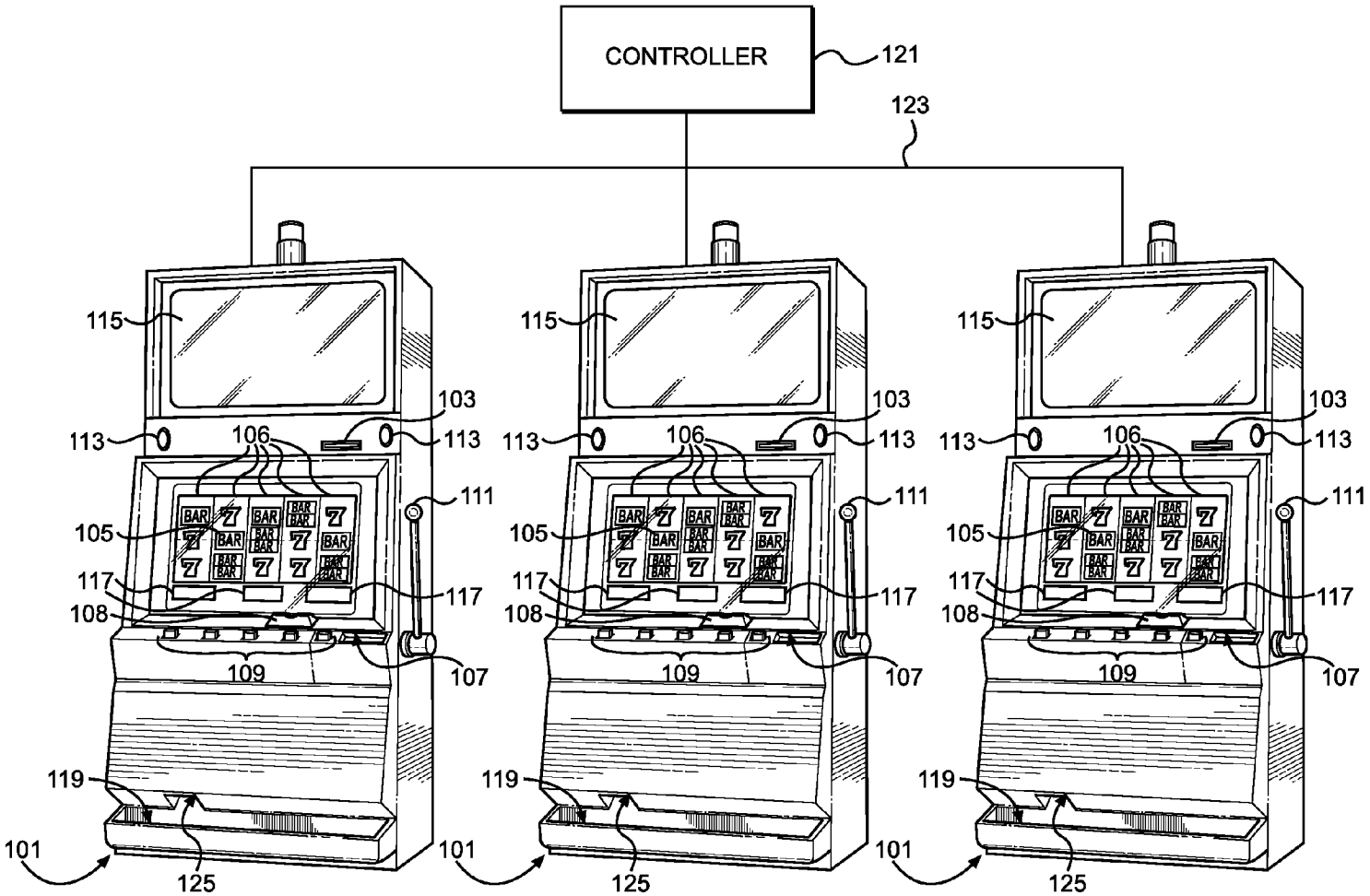
FIG. 1A shows electronic gaming machines for playing a game connected to a network controlled by a server.

DETAILED DESCRIPTION OF THE INVENTION:

The present invention will now be described more fully with reference to the accompanying drawings. It should be understood that the invention may be embodied in many different forms and should not be construed as limited to the embodiments set forth herein. Throughout FIGS. 1-6, like elements of the invention are referred to by the same reference numerals for consistency purposes.

FIG. 1A shows a group of electronic gaming machines ("EGM") connected to a central controller. Each EGM 101 is a wagering device that is used in a casino and may be configured to display and play any of a number of different types of games, including but not limited to electromechanical spinning reel type slot games, video reel games, video poker, keno, roulette, craps, blackjack, or any other type of wagering game.

A group of EGMs 101 forms a bank that may be connected together for different types of system applications. For example, a group of EGMs 101 may be linked together for bonusing in a variety of ways, including progressive bonuses where a portion of an amount wagered is applied to a progressive meter that advances as additional games are played. It is also common for EGMs in a casino establishment to be connected to systems for player tracking so that the casino can keep track of the amount of play by each individual player. In that case, each player is issued a player tracking device such as a card that is inserted into a card slot 103 on EGM 101 during play. The card identifies the player to the system and all wagered amounts are tracked for loyalty rewards and other marketing programs of the casino. Other systems connecting EGMs 101 are used for accounting purposes so that a casino operator can monitor and track play, and assess performance of EGMs across the entire casino floor.

Each EGM 101 has a number of components. A display 105 is used to show game play and resulting outcomes, and may be in the form of a video display (shown), or alternatively, physical reels. Touch screen displays are included on most EGMs and provide a flexible interface for operation of EGM 101, including displaying symbols 106 during play. Other components include a bill validator and a coin acceptor that are both housed inside EGM 101 into which bills may be inserted through bill slot 107 and coins may be inserted through coin head 108, respectively. Buttons 109 on the exterior of EGM 101 are used to control certain EGM operations in conjunction with touch screen display 105. A handle 111 may be used to initiate play of a game and speakers 113 are used to provide sounds in conjunction with game play and other EGM operations. EGMs further include a top box 115 for displaying pay tables, artwork, advertising or other types of information either on fixed glass or on other displays such as an integrated video panel. Top box 115 may be fitted with a liquid crystal display ("LCD") screen to permit aspects of game play from either a base game or a secondary game to be shown in top box 115. Meters 117 for tracking credits available for play and other amounts are positioned near the bottom or screen 105. A coin tray 119 at the bottom of EGM 101 is used to catch coins as they are dispensed to a player. It is also common for EGM 101 to include a ticket-in, ticket-out ("TITO") component that is part of the bill validator housed inside of EGM 101 that may accept bar coded credits through slot 107 and for which the value of the credits is displayed on meters 117 upon a ticket being inserted.

All operational functions of EGM 101 are controlled by a controller such as a microprocessor (not shown) housed in side EGM 101. The controller executes instructions that include operation of a random number generator ("RNG") that is well known to those of ordinary skill in the art. Game outcomes are determined based on the results corresponding to the numbers selected by the RNG.

Figure 2A:
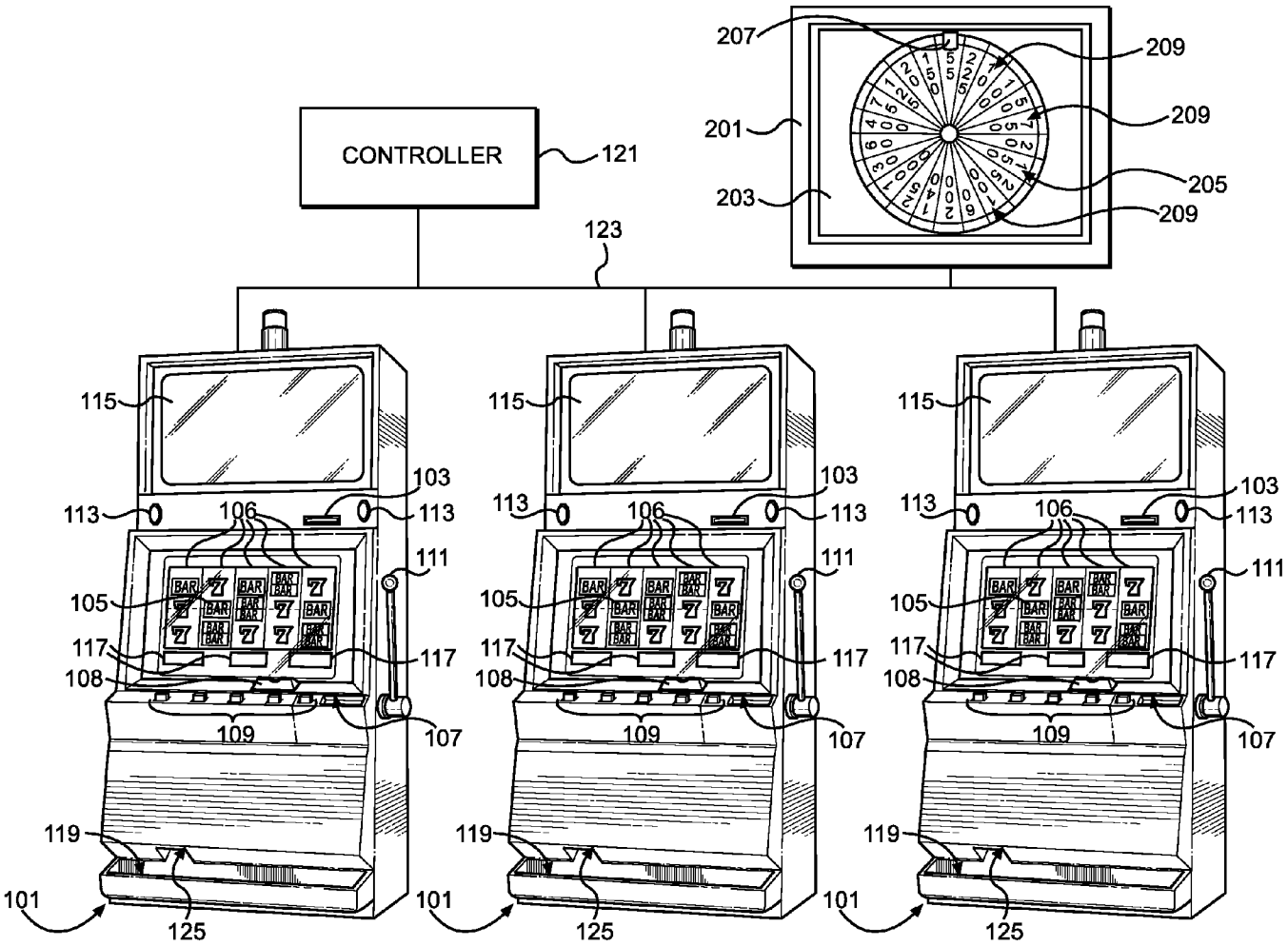
FIG. 2A shows electronic gaming machines for playing a game connected to a network controlled by a server and including a networked secondary game display.

In the system of FIG. 1A, EGMs 101 are connected to a controller 121 that is used to interface with EGMs 101 to perform a number of different functions, depending on how games on EGMs 101 are configured to operate. For example, controller 121 may instruct EGMs 101 to dispense cash bonuses based on winning events on a networked bonus feature such as a bonus wheel 201 as shown in FIG. 2A. Controller 121 is a microprocessor based device such as a computer or server that is in two-way communication with each of the EGMs 101 in a multi-device system over a network connection 123. Controller 121 receives signals from EGM 101 that may indicate any of a number of different types of events occurring on EGM 101.

FIGS. 1B-1F show a number of general purpose computing devices which may be used to play a game. These figures show a smartphone 171 in FIG. 1B which may be an Apple iPhone 4S® as pictured, or any other mobile phone type device. A tablet computer 173 is shown in FIG. 1C which may be an Apple iPad 3® as pictured, or any other tablet computing device. A desktop computer 175 is shown in FIG. 1D which may be a Lenovo® machine as pictured, or any other desktop computer. A laptop computer 177 is shown in FIG. 1E which may be a Lenovo® computer or any other laptop computer. And, a home video gaming device 179 is shown in FIG. 1F which may be a Microsoft Xbox® system or any other home video system. Other types of network connected devices could also be used to play games including portable video gaming devices such as a Sony PSP®, a Nintendo GameBoy®, or an internet connected television with a browser or app capabilities. Any of these devices is capable of playing a game, including a wagering game, through an app loaded onto the device or through a website accessible using a browser on the device. In the case of the networked game, payment may be made by credit card, Paypal® or another payment service. The RNG is run securely on a server based system and then delivers the outcomes over the internet to be displayed on the general purpose computing device.

FIG. 2A shows a group of EGMs 101 and controller 121 connected on network 123 along with a bonus device 201. Bonus device 201 is in the form of a wheel 203 with different potential winning outcome amounts 205 shown on it. Bonus device 201 also includes an indicator 207 to indicate the winning position when wheel 203 comes to a stop. Prize values 209 or other symbols representing different outcomes are shown in the different positions or segments of wheel 203. It should be understood that bonus device 201 may alternatively be a screen for displaying a bonus indicator such as a wheel or any other indicator representation. Further, bonus device 201 may alternatively be incorporated in the housing of EGM 101 such as in top box 115, or it may be a separate device situated nearby to EGM 101 and shared by more than one EGM 101 so that it may be displayed prominently for visitors to a casino establishment to see thereby raising the excitement level for the player playing and the other casino customers. Bonus device 201 may take the form of any bonus indicator, a variety of which are known, including but not limited to reels, "pick a prize" reveal type bonus indicators, timers, arrows, etc. Bonus device 201 may also be in the form of a dedicated device specifically designed for a particular type of bonus, such as a wheel.

In FIG. 2A, EGM 101 is shown as a casino gaming device of the type depicted in FIG. 1A. It should be understood that any one or more of the general purpose computing devices of FIG. 1B-1F—smartphone 171, tablet computer 173, desktop computer 175, laptop computer 177, or home video gaming system 179 shown in FIGS. 1B-1F—could be placed on a network connected to server based system 221 and used to deliver a game as described herein. For purposes of this specification, reference to one or more EGMs 101 in an environment using a limited access intranet of the type typically found in a casino would also apply to one or more general purpose computing devices with a secure connection to a server over the internet and not involving a physical casino property at all, and which may or may not require a wager or payment to play.

Figure 2B:
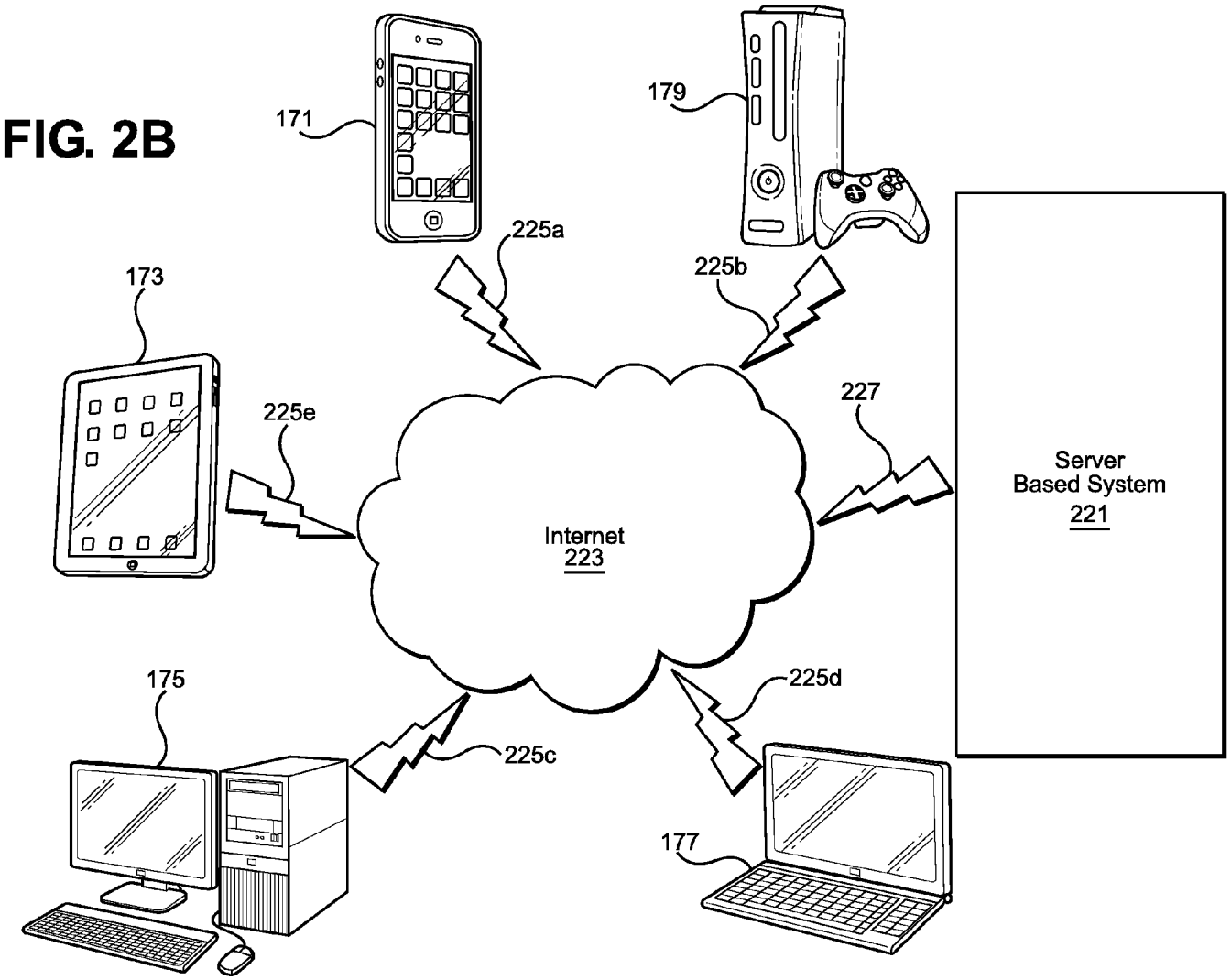
FIG. 2B shows a group of electronic gaming machines on a network connected to a server based system and an external system.

FIG. 2B shows server based system 221 connected to a network with multiple computing devices for playing games. It should be understood that the network shown in FIG. 2B operates in a manner similar to the network of FIG. 2A, except that the computing devices on the network of FIG. 2B are connected over the internet 223 with each device 171-179 connected over a secure connection 225*a-e* to server based system 221 which connects to internet 223 over network connection 227. Payments can be made securely over internet 223 using connections 225*a-e*, and then delivered to an operator over connection 227. Similarly, the game is executed on server based system 221 using a secure RNG with the outcomes being delivered to the individual devices 171-179 over internet 223. Alternatively, the game software or a portion of it may be resident and executed on each device 171-179. Wagers by players and payments to players may be made using accounts set up with an operator of a website on which the games are run.

It will be understood that the type of network over which data is communicated can be one of several different types of networks. These networks include a Local Area Network (LAN), Wide Area Network (WAN), an intranet or the Internet. Other proprietary networks could also be used without departing from the principles of the invention. This would include such networks as a Windows network or an Ethernet network.

Figure 3:
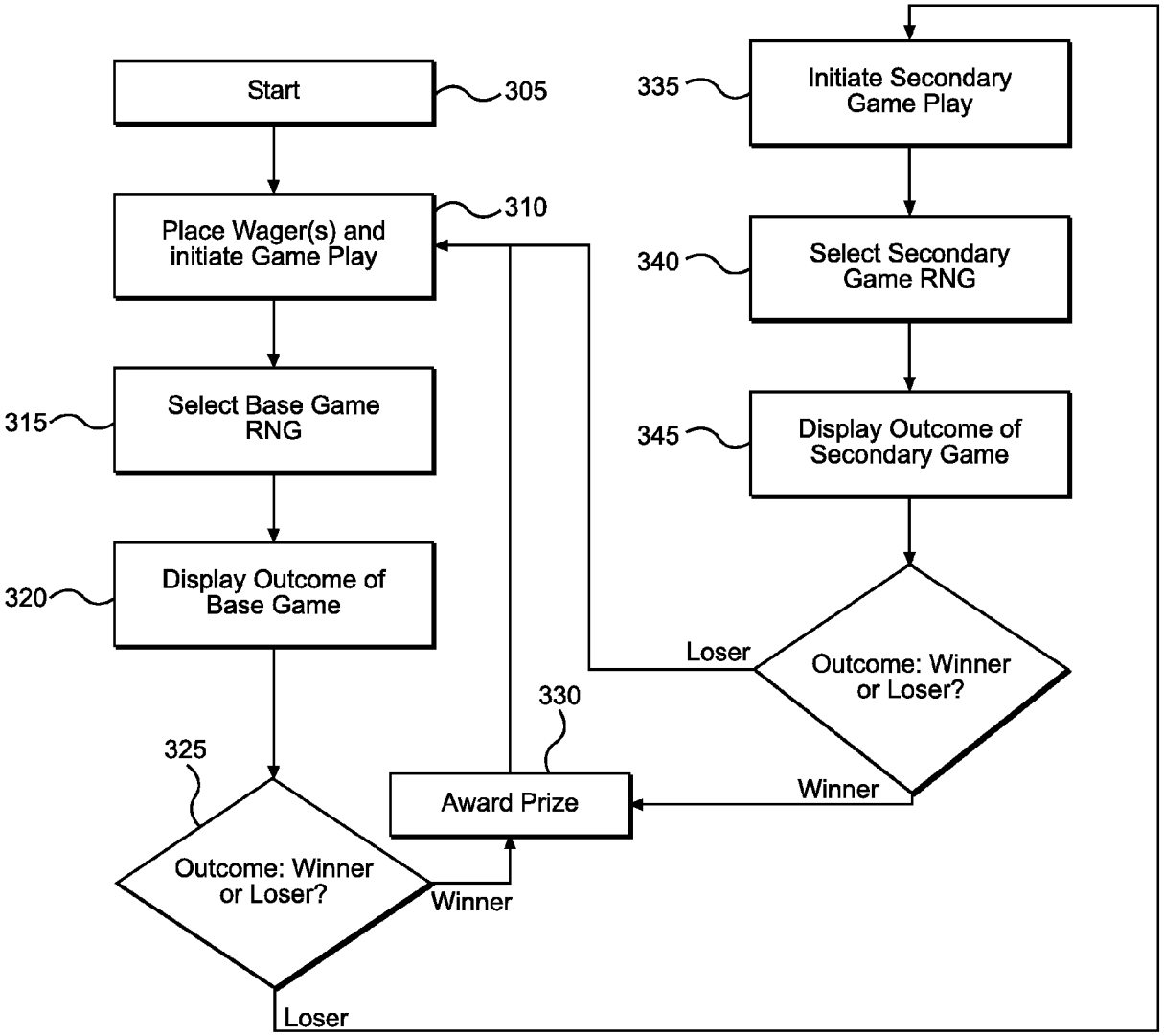
FIG. 3 shows a flow chart of game play on an electronic gaming machine with a base game and a second chance game.

For the EGMs and connected networks shown in FIGS. 1-2, the game play of the invention follows a sequence of steps shown in the flow chart of FIG. 3. The player begins at start 305 and places a wager 310 to initiate play on EGM 101. The wager may be a single wager that allows the player to play a base game and be eligible for a secondary game. Or, the wager may have two components, a first base game wager permitting the player to play the base game and a second, optional wager, for the player to be eligible for participation in the secondary game, depending on the outcome of the base game.

Once the wager or wagers are placed, a base game RNG is selected 315 and the corresponding outcome for the base game is displayed 320. The base game outcome may be either a winner or a loser and that determination is made at step 325. If it is a winner, the player is awarded the appropriate prize at step 330, usually in the form of credits added to a credit meter that is one of meters 117. Once the award is made, the player is returned to the step of placing a wager 310.

In the event that the outcome of the base game is a loser, the player is offered the opportunity to initiate a secondary game. Eligibility for the secondary game may be provided in a number of possible ways. First, it may be part of the overall game play with no additional wager being required. Second, it may be contingent on a separate wager at the "place wager" step 310. Or third, it may be contingent on a separate wager placed at the time of the determination of the outcome of the base game at step 325. Once eligibility is established, the player is given the opportunity to play the secondary game 335. A secondary game RNG is then selected 340, and the corresponding outcome of the secondary is displayed 345. The secondary game outcome may be either a winner or a loser and that determination is made at step 345. If it is a winner, the player is awarded the appropriate prize 330, and returned to begin a new game at the "place wager" step 310. If the outcome of the secondary game is a loser, the player is returned directly to the place wager step 310 without being awarded a prize.

Figure 4:
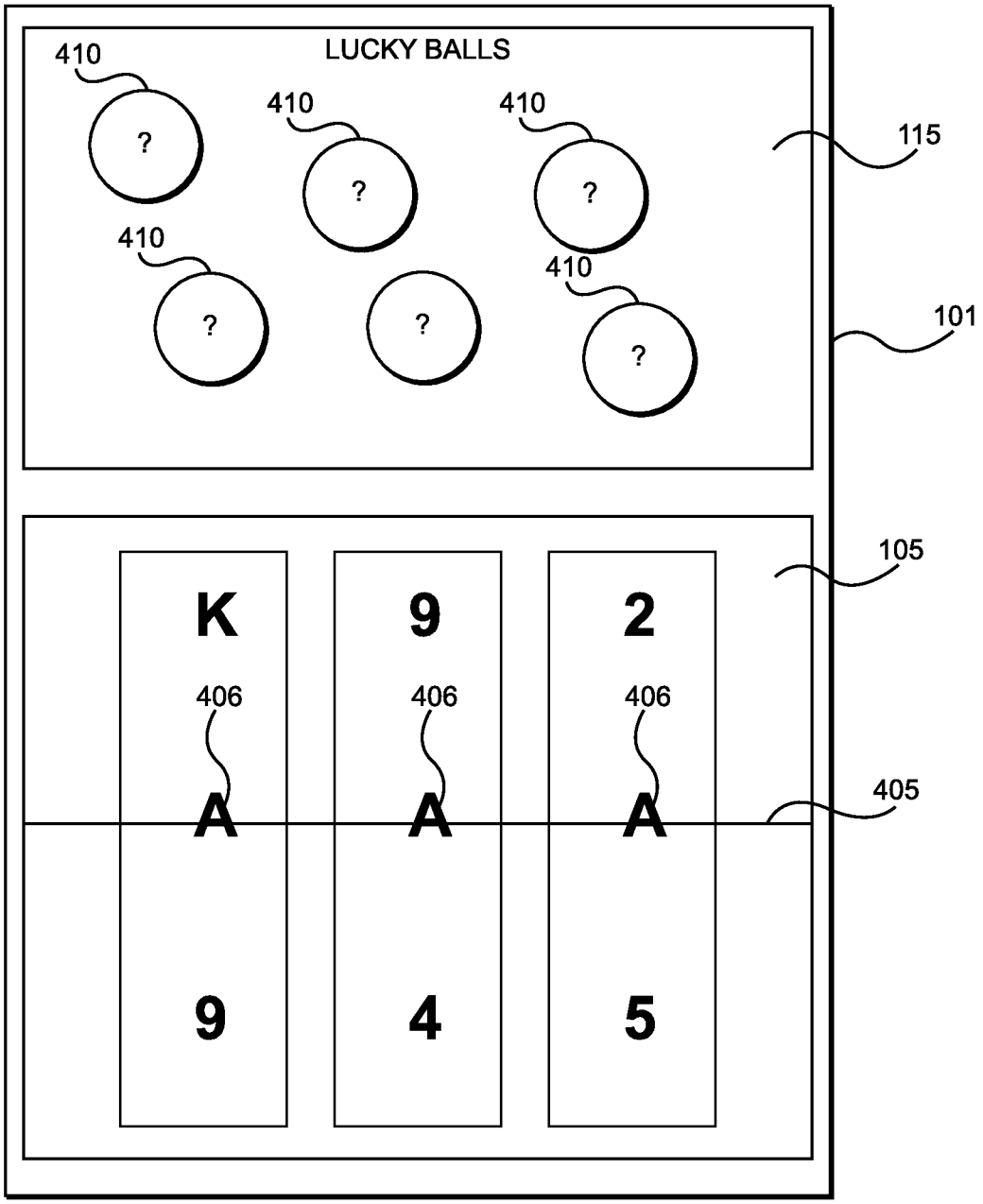
FIGS. 4 shows a game play sequence of a first game on an electronic gaming machine with a base game and a second chance game.

FIG. 4 shows a screen shot of displays 105 and 115 of EGM 101 during play of a base game. In FIG. 4, display screen 105 shows symbols 406 representing the outcome of a game on EGM 101. Once play has ended, it is determined whether the player has won or lost. In the representative display shown in FIG. 4, the player has won by lining up 3 aces on pay line 405. In that case, the game ends, the player is awarded a prize, and the player may start again from the beginning by placing a wager for a new game. The player is not eligible for a secondary game, such as the "Lucky Balls" game that displays lucky balls 410 in top box 115 because the outcome of the base game was not a loser.

Figure 5B:
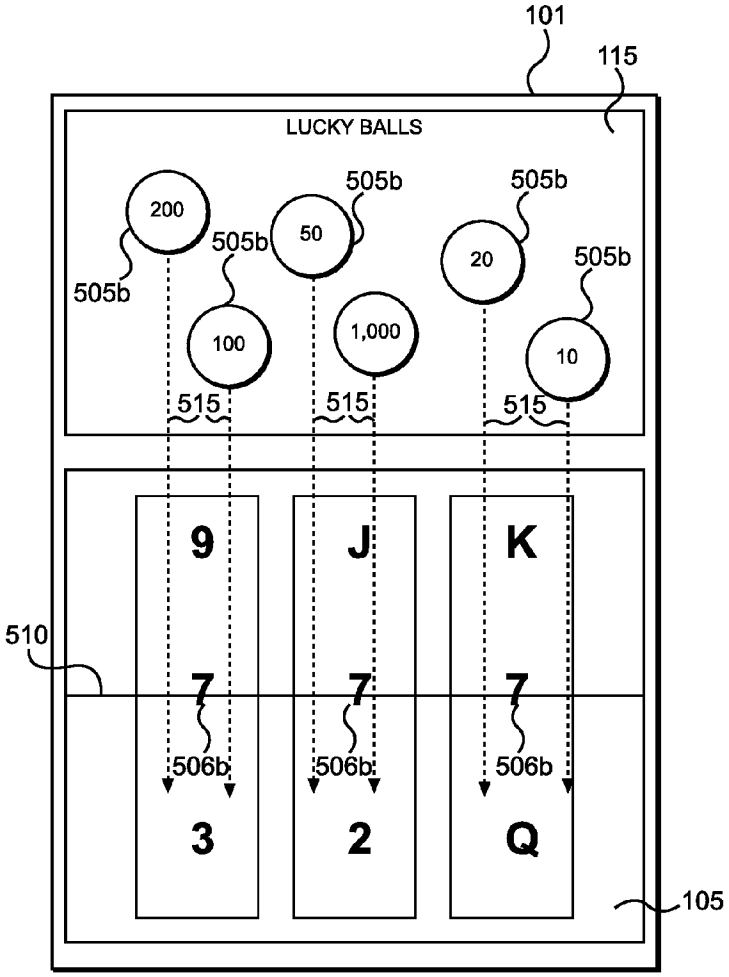
FIGS. 5A-B shows a game play sequence of an alternative game on an electronic gaming machine with a base game and a second chance game.
Figure 5A:
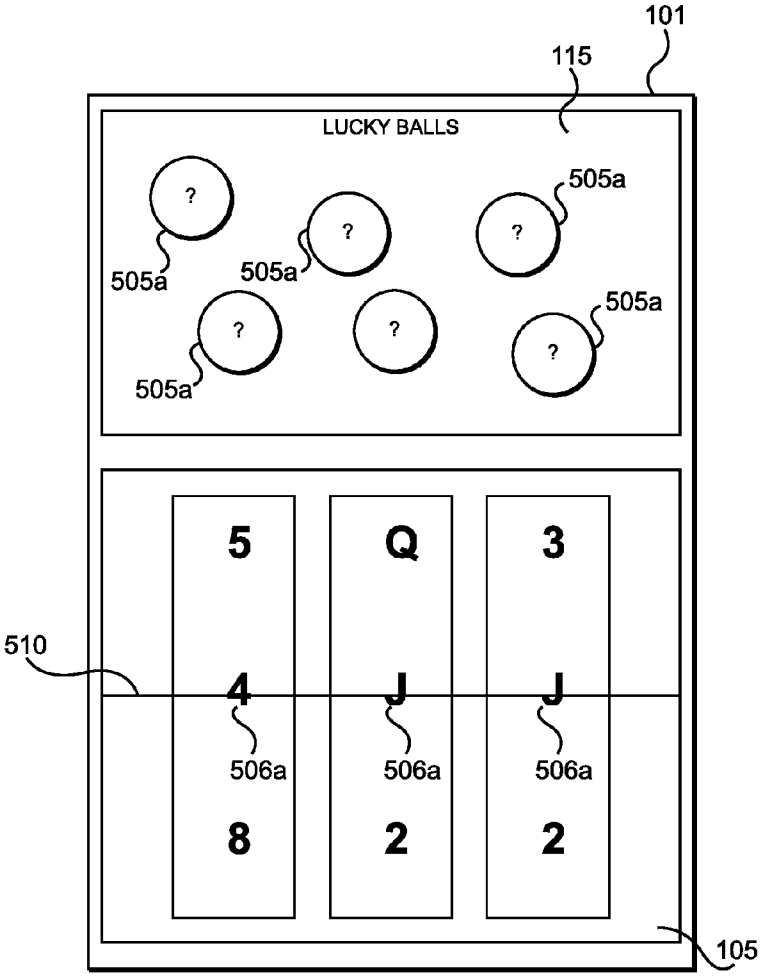

FIGS. 5A-5B show screen shots of displays 105 and 115 of EGM 101 during play of a base game and secondary game respectively. In FIG. 5A, display screen 105 shows symbols 506*a* representing the outcome of a game on EGM 101. The screen shot of top box 115 shows mystery lucky balls 505*a* that are part of the secondary game. Once representative symbols 506*a* displayed on the reels in FIG. 5A, the player has lost by lining up three symbols 506*a*—a 4 and two jacks—on pay line 510. In that case, the player may be eligible for the secondary game depending on whether a separate wager is required. If a separate wager is not required, or if a separate wager is required and the player has placed the separate wager, the player is offered the opportunity to start the secondary game. Otherwise, the player is not eligible for the secondary game and may start play again at step 305.

FIG. 5B shows a screen shot of displays 105 and 115 for the secondary game. The secondary game includes a second spin of the reels which results in three symbols 506*b*—all 7s—being lined up on payline 510. In the "Lucky Balls" embodiment shown in FIGS. 5A-5B, a set of mystery Lucky Balls 505*a* are activated with bonus amounts to become active as Lucky Balls 505*b*. Active Lucky Balls 505*b* slowly descend down display screen 115 and continue down display screen 105 as indicated by the dashed arrow lines 515. One or more of active Lucky Balls 505*b* may come to a stop and change color indicating that they are chosen. Other forms of indicating one or more chosen winning balls (or other indicators of any shape or size) may also be implemented in the game. The values shown in the winning balls are then added together to generate a prize that is awarded to the player. The non-chosen balls may fade out on the screen, burst or otherwise indicate that they are not chosen. If symbols 506*b* on payline 510 are a losing combination, active Lucky Balls 505*b* do not descend and no secondary game prize is awarded.

Figure 6B:
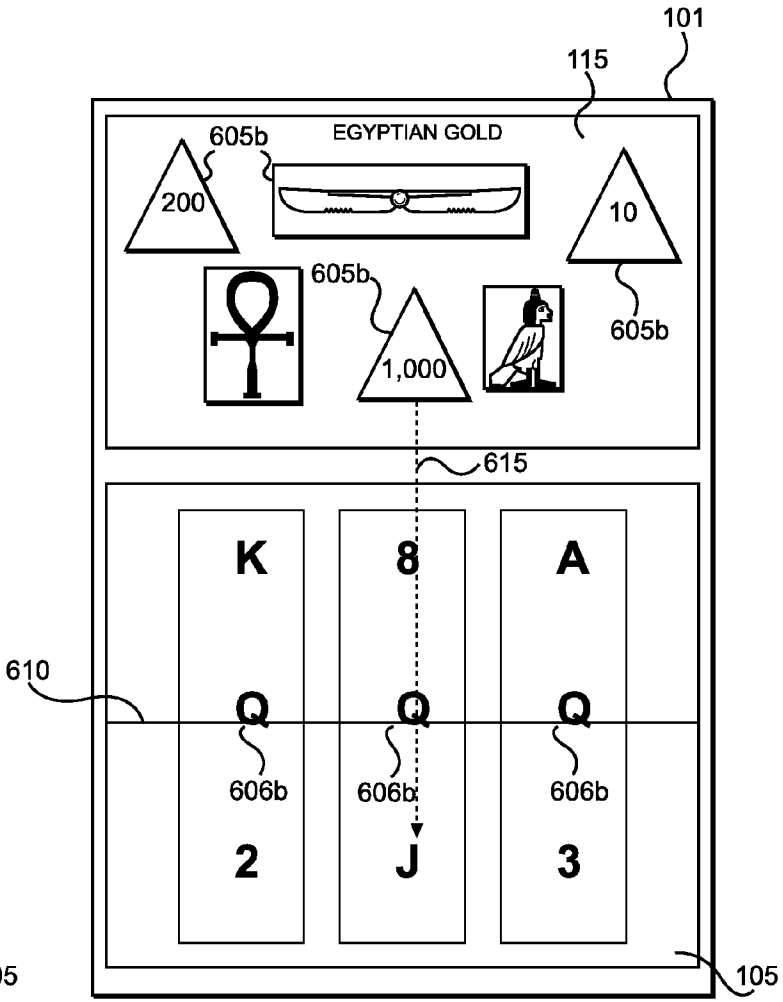
FIGS. 6A-B shows a game play sequence of another alternative game on an electronic gaming machine with a base game and a second chance game.
Figure 6A:
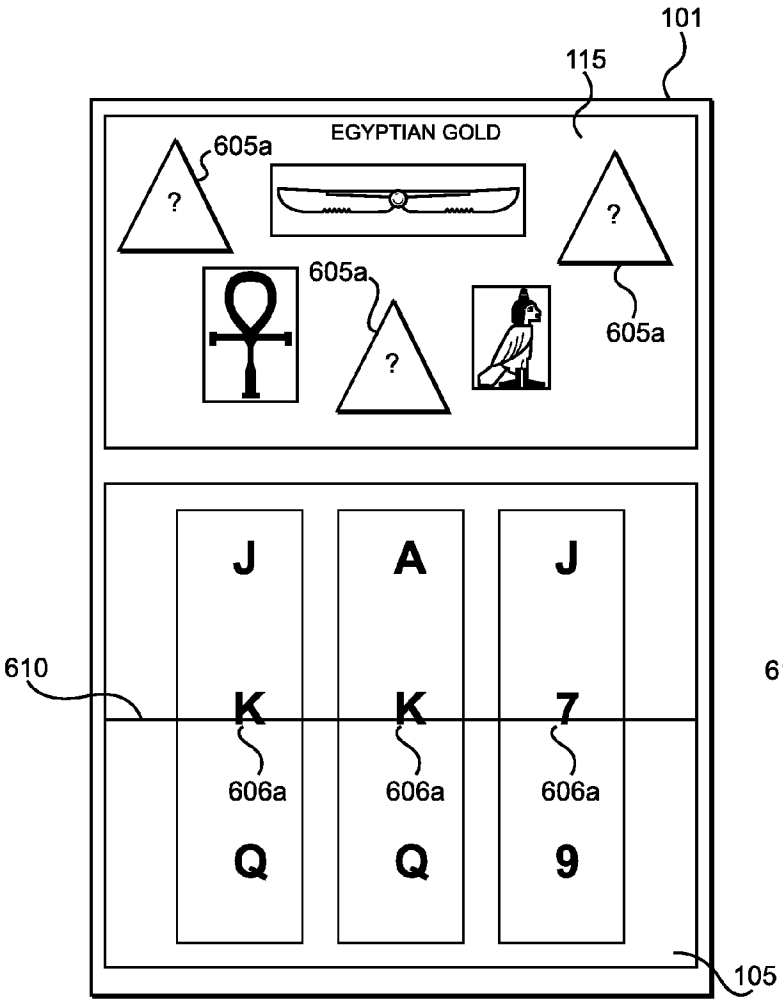

FIGS. 6A-6B show screen shots of displays 105 and 115 of EGM 101 during play of an alternative base game and secondary game respectively. In FIG. 6A, display screen 105 shows symbols 606*a* representing the outcome of a game on EGM 101. The screen shot of top box 115 shows mystery Egyptian pyramids 605*a* that are part of the secondary game. Once play has ended, it is determined whether the player has won or lost. For the representative symbols 606*a* displayed on the reels in FIG. 6A, the player has lost by lining up three symbols 606*a*—two kings and a 7—on pay line 610. In that case, the player may be eligible for the secondary game depending on whether a separate wager is required. If a separate wager is not required, or if a separate wager is required and the player has placed the separate wager, the player is offered the opportunity to start the secondary game.

FIG. 6B shows a screen shot of displays 105 and 115 for the secondary game. The secondary game includes a second spin of the reels which results in three symbols 606*b*—all queens—being lined up on payline 610. In the "Egyptian Gold" embodiment shown in FIGS. 6A-6B, a set of Egyptian pyramids 605*b* are activated with bonus amounts. One or more of the pyramids slowly descends down display screen 115 and continue down display screen 105 as indicated by the dashed arrow line 615. One or more of the pyramids 605*b* may come to a stop and change color indicating that they are chosen. Other forms of indicating one or more chosen winning pyramids (or other indicators) may also be implemented in the game. The values shown in the chosen pyramids are then added together to generate a prize that is awarded to the player. The non-chosen pyramids may fade out on the screen, blow away in a sandstorm or otherwise indicate that they are not chosen. If symbols 606*b* on payline 610 are a losing combination, the pyramids do not descend and no secondary game prize is awarded.

While the invention has been described with respect to the figures, it will be appreciated that many modifications and changes may be made by those skilled in the art without departing from the spirit of the invention. For example, the secondary game may be a wheel indicator as shown in FIG. 2A which may be substituted for the descending lucky balls or Egyptian pyramids shown in FIGS. 5A-B and FIGS. 6A-6B respectively. In addition, the "Lucky Balls" or pyramids depicted in the figures may be any figure, including a shape, a ball, a balloon, a cube, an animal or creature, or any other icon that may be shown, including an icon or symbol that is part of a theme of the game. Any variation and derivation from the above description and drawings are included in the scope of the present invention as defined by the claims.

What is claimed is:

1. An electronic gaming machine ("EGM") on which a player plays a base game with an opportunity to play a second chance game, comprising:

a random number generator for generating random numbers that determine the outcome of a base game and that correspond to a predefined set of game outcomes including winning and losing outcomes;

a display for displaying game play screens including game outcomes to a player;

a controller for controlling game play on the electronic gaming machine wherein in the event that the controller determines a winning outcome on the base game, the display indicates the winning outcome to the player and the game ends, and further wherein in the event the controller determines a losing outcome in the base game, the display indicates the losing outcome to the player and the controller causes a second chance game to be offered to the player;

an EGM interface through which a player interacts with the EGM to accept or reject the second chance game offered to the player;

wherein if the player rejects the second chance game offered, the game ends; and further wherein if the player accepts the second chance game offer, a second chance game outcome is determined and a winning outcome results in the player receiving an award and the game ending, and a losing outcome results in the game ending without the player receiving an award.

2. The EGM of claim 1 further comprising a second display for displaying game effects indicating one or more potential prizes that may be awarded to the player depending upon the outcome of the second chance game.

3. The second display of claim 2 wherein the second display is in communication with the controller for display of the second chance game.

4. The second display of claim 3 wherein the second display is located outside of the EGM and is shared with other EGMs.

5. The EGM of claim 2 wherein the game effects are in the form of one or more figures that are depicted to move on either the display or the second display wherein one or more of the figures are selected to be awarded to the player at the end of the second chance game and the value of such figures are added together and indicated to the player as the award.

6. The EGM of claim 5 wherein the figures are in a form selected from one of the group comprising: a) a shape; b) a ball; c) a balloon; d) a cube; e) an animal or creature; or f) any other icon or symbol.

7. The EGM of claim 1 further comprising a bonus indicator for displaying the second chance game that is housed separately from the EGM.

8. The EGM of claim 1 further comprising a network of gaming machines wherein second chance game prizes are aggregated from and determined based upon play on a plurality of EGMs connected to the network.

9. The EGM of claim 1 wherein the player places a wager to play the game.

10. The EGM of claim 1 further comprising a network and a server which are configured to allow communications between the EGM and the server for the exchange of game content, payment data and other information to permit EGM to operate on the network.

11. A method of playing a game on an electronic gaming machine ("EGM") having a controller that executes a random number generator program implemented in software and a display, comprising:

selecting a base game random number by the controller that is converted to a game outcome for the base game wherein the base game outcome is one of a plurality of outcomes in a predefined set including winning and losing outcomes;

determining whether the base game outcome is a winning outcome or a losing outcome;

displaying the base game outcome on the display;

paying a base game award and ending the game when the base game outcome is determined to be a winning outcome;

offering a second chance game on the display when the base game outcome is determined to be a losing outcome;

if the second chance game offer is rejected, ending the game;

if the second chance game offer is accepted, selecting a second chance game random number that is converted to a second game outcome for the second chance game wherein the second chance game outcome is one of a plurality of outcomes in a predefined set including winning and losing outcomes;

displaying a second chance game outcome on the display upon completion of the second chance game; and awarding a prize if the second chance game outcome is a winning outcome and ending the game, or ending the game if the second chance game outcome is a losing outcome without awarding a prize.

12. The method of claim 11 further comprising placing a wager.

13. The method of claim 11 further comprising placing a second chance game wager to be eligible for the second chance game.

14. The method of claim 11 further comprising aggregating second chance game wagers from a plurality of electronic gaming machines connected on a network to form a prize pool from which second chance game prizes may be awarded.

15. The method of claim 11 wherein the game effects indicating the second chance game outcome are in the form of one or more figures that are depicted to move on either the display or the second display wherein one or more of the figures are selected to be awarded to the player at the end of the second chance game and the value of such figures are added together and indicated to the player as the award.

16. The method of claim 15 wherein the figures are in a form selected from one of the group comprising: a) a shape; b) a ball; c) a balloon; d) a cube; e) an animal or creature; or f) any other icon or symbol.

17. The method of claim 11 wherein a network and a server are connected to the EGM to allow communications between the EGM and the server for the exchange of game content, payment data and other information to permit EGM to operate on the network.

18. The method of claim 17 wherein at least one other EGM is connected to the server on the network.

* * * * *